US008855540B2

(12) United States Patent
Kikuchi et al.

(10) Patent No.: US 8,855,540 B2
(45) Date of Patent: Oct. 7, 2014

(54) FUSER FOR EQUALIZING TEMPERATURE OF HEAT GENERATING SECTION

(75) Inventors: Kazuhiko Kikuchi, Kanagawa (JP); Masahiro Doi, Shizuoka (JP); Toshihiro Sone, Kanagawa (JP); Shuji Yokoyama, Shizuoka (JP); Tadashi Noguchi, Shizuoka (JP); Satoshi Kinouchi, Tokyo (JP); Ryota Saeki, Shizuoka (JP); Shigeru Fujiwara, Kanagawa (JP); Shoko Shimmura, Kanagawa (JP); Kazutoshi Takahashi, Shizuoka (JP); Takafumi Amano, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 199 days.

(21) Appl. No.: 13/482,881

(22) Filed: May 29, 2012

(65) Prior Publication Data

US 2012/0308278 A1 Dec. 6, 2012

Related U.S. Application Data

(60) Provisional application No. 61/492,802, filed on Jun. 2, 2011, provisional application No. 61/502,305, filed on Jun. 28, 2011, provisional application No. 61/502,306, filed on Jun. 28, 2011, provisional application No. 61/502,307, filed on Jun. 28, 2011, provisional application No. 61/528,669, filed on Aug. 29, 2011.

(51) Int. Cl.
*G03G 15/20* (2006.01)
*H05B 6/14* (2006.01)

(52) U.S. Cl.
CPC ..... *H05B 6/145* (2013.01); *G03G 15/2032* (2013.01); *G03G 15/2053* (2013.01)
USPC ..... 399/329

(58) Field of Classification Search
CPC ..... G03G 15/2053; G03G 15/2032; G03G 2215/2025; G03G 2215/2029
USPC ..... 399/69, 329
See application file for complete search history.

(56) References Cited

U.S. PATENT DOCUMENTS

| | | | | |
|---|---|---|---|---|
| 2006/0029444 | A1 | 2/2006 | Naito et al. | |
| 2007/0148438 | A1 * | 6/2007 | Pickering et al. | 428/327 |
| 2009/0034275 | A1 * | 2/2009 | Cheng et al. | 362/373 |
| 2009/0290916 | A1 * | 11/2009 | Baba | 399/329 |
| 2010/0034568 | A1 * | 2/2010 | Sone et al. | 399/331 |

* cited by examiner

*Primary Examiner* — David Gray
*Assistant Examiner* — Gregory H Curran
(74) *Attorney, Agent, or Firm* — Patterson & Sheridan LLP

(57) ABSTRACT

According to one embodiment, a fuser includes a fixing belt including a conductive layer, an induction-current generating section to electromagnetically induction-heat the conductive layer, an opposed section to form a nip in cooperation with the fixing belt, an auxiliary heat generating section electromagnetically induction-heated by the induction-current generating section, and a moving section to move the auxiliary heat generating section with respect to the fixing belt.

13 Claims, 13 Drawing Sheets

PRESS ROLLER CONTACT STATE

PRESS ROLLER SEPARATED STATE

FUSER FOR EQUALIZING TEMPERATURE OF HEAT GENERATING SECTION

CROSS-REFERENCE TO RELATED APPLICATION

This application is based upon and claims the benefit of priority from Provisional U.S. Applications 61/492,802 filed on Jun. 2, 2011, 61/502,305 filed on Jun. 28, 2011, 61/502,306 filed on Jun. 28, 2011, 61/502,307 filed on Jun. 28, 2011, and 61/528,669 filed on Aug. 29, 2011, the entire contents of which are incorporated herein by reference.

FIELD

Embodiments described herein relate generally to a fuser used in an image forming apparatus and configured to equalize the temperature of a heat generating section.

BACKGROUND

As a fuser used in an image forming apparatus such as a copying machine or a printer, there is a fuser including a heat generating section with a small heat capacity in order to save energy and reduce a warming-up time. As the fuser including the heat generating section with a small heat capacity, there is an apparatus including an auxiliary heat generating section that supplements insufficiency of a heat quantity and heat pipes that prevent temperature unevenness that occurs in the heat generating section.

Since the auxiliary heat generating section and the heat pipes respectively have heat capacities, if the heat generating section starts warming-up or the heat generating section starts reset from a sleep mode, it is likely that, in the beginning, the auxiliary heat generating section deprives the heat of the heat generating section and prevents a reduction in a warming-up time or a reset time from the sleep mode.

DETAILED DESCRIPTION

In general, according to one embodiment, a fuser includes: a fixing belt including a conductive layer; an induction-current generating section to electromagnetically induction-heat the conductive layer; an opposed section to form a nip in cooperation with the fixing belt; an auxiliary heat generating section electromagnetically induction-heated by the induction-current generating section; and a moving section to move the auxiliary heat generating section with respect to the fixing belt.

Embodiments are explained below.

First Embodiment

Figure 1:
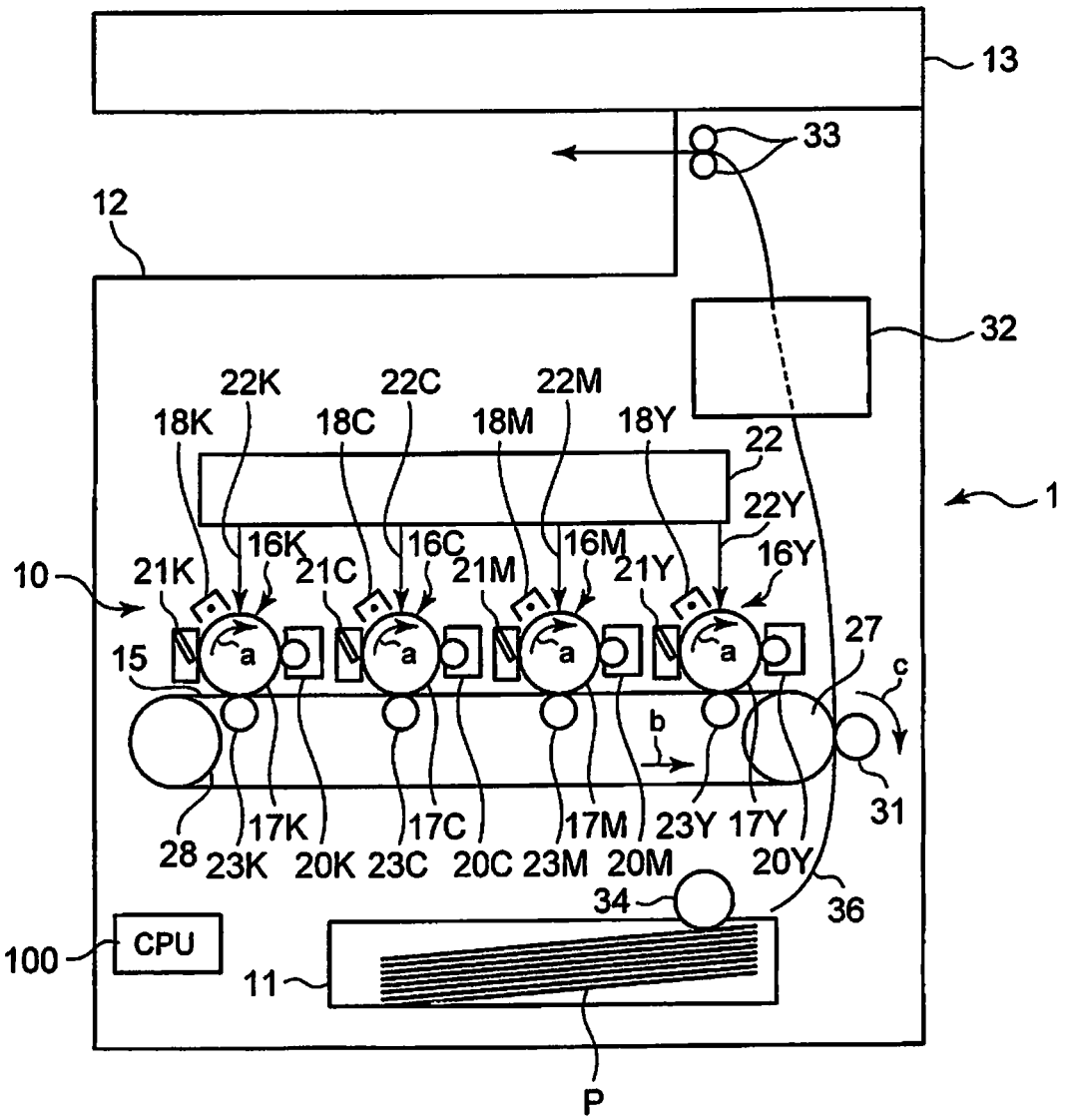
FIG. 1 is a schematic configuration diagram of an MFP mounted with a fuser according to a first embodiment.

FIG. 1 is a schematic configuration diagram of a color MFP (Multi Functional Peripheral) 1, which is an image forming apparatus of a tandem type, mounted with a fuser according to a first embodiment. The MFP 1 includes a printer section 10, as an image forming section, a paper feeding section 11, a paper discharge section 12, and a scanner 13. The MFP 1 includes a CPU 100 that controls the entire MFP 1.

The printer section 10 includes four sets of image forming stations 16Y, 16M, 16C, and 16K for Y (yellow), M (magenta), C (cyan), and K (black) arranged in parallel along an intermediate transfer belt 15. The image forming stations 16Y, 16M, 16C, and 16K respectively include photoconductive drums 17Y, 17M, 17C, and 17K.

The image forming stations 16Y, 16M, 16C, and 16K respectively include, around photoconductive drums 17Y, 17M, 17C, and 17K that rotate in an arrow "a" direction, chargers 18Y, 18M, 18C, and 18K, developing devices 20Y, 20M, 20C, and 20K, and photoconductive member cleaners 21Y, 21M, 21C, and 21K. The printer section 10 includes a laser exposure device 22 included in an image forming unit. The laser exposure device 22 irradiates laser beams 22Y, 22M, 22C, and 22K corresponding to the respective colors respectively to the photoconductive drums 17Y, 17M, 17C, and 17K. The laser exposure device 22 irradiates the laser beams to form electrostatic latent images respectively on the photoconductive drums 17Y, 17M, 17C, and 17K.

The printer section 10 includes a backup roller 27 and a driven roller 28 that support the intermediate transfer belt 15. The printer section 10 causes the intermediate transfer belt 15 to travel in an arrow "b" direction. The printer section 10 includes primary transfer rollers 23Y, 23M, 23C, and 23K respectively in positions opposed to the photoconductive drums 17Y, 17M, 17C, and 17K via the intermediate transfer belt 15. The primary transfer rollers 23Y, 23M, 23C, and 23K respectively primarily transfer toner images formed on the photoconductive drums 17Y, 17M, 17C, and 17K onto the intermediate transfer belt 15 and sequentially superimpose the toner images. The photoconductive member cleaners 21Y, 21M, 21C, and 21K respectively remove toners remaining on the photoconductive drums 17Y, 17M, 17C, and 17K after the primary transfer.

The printer section 10 includes a secondary transfer roller 31 in a position opposed to the backup roller 27 via the intermediate transfer belt 15. The secondary transfer roller 31 rotates in an arrow "c" direction following the intermediate transfer belt 15. The printer section 10 picks up a sheet P as a recording medium, from the paper feeding section 11 using a pickup roller 34. The printer section 10 feeds the sheet P to the position of the secondary transfer roller 31 along a conveying path 36 to be timed to coincide with timing when the toner images on the intermediate transfer belt 15 reach the position of the secondary transfer roller 31. During secondary transfer, the printer section 10 forms a transfer bias in a nip between the intermediate transfer belt 15 and the secondary transfer roller 31 and collectively secondarily transfers the toner images on the intermediate transfer belt 15 onto the sheet P.

The printer section 10 includes a fuser 32 and a paper discharge roller pair 33 downstream of the secondary transfer roller 31 along the conveying path 36.

If the MFP 1 starts print, the MFP 1 transfers an image formed by the printer section 10 onto the sheet P, fixes the image on the sheet P, and discharges the sheet P to the paper discharge section 12.

The image forming apparatus is not limited to the tandem type. The number of developing devices is not limited either. The image forming apparatus may directly transfer toner images from photoconductive members onto a recording medium.

Figure 2:
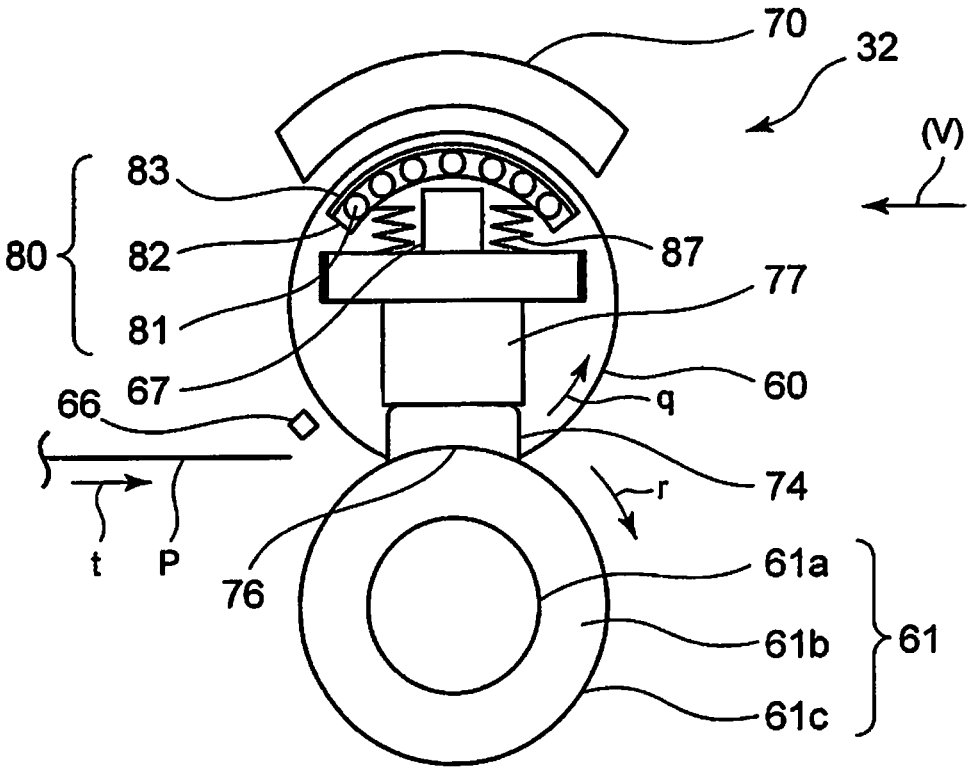
FIG. 2 is a schematic configuration diagram of the fuser viewed from a side.
Figure 3:
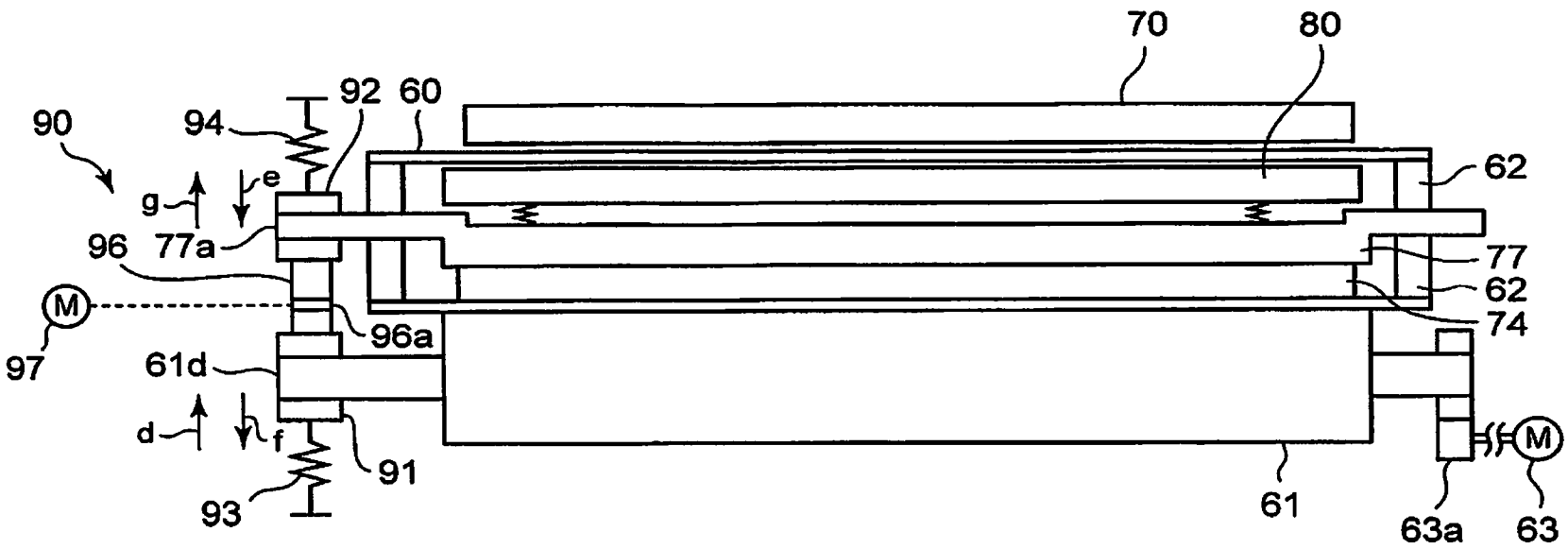
FIG. 3 is a schematic configuration diagram of the fuser viewed from the front.

The fuser 32 is explained in detail. As shown in FIGS. 2 and 3, the fuser 32 includes a fixing belt 60, a press roller 61 as an opposed section, an induction-current generating coil (hereinafter abbreviated as IH coil) 70 as an induction-current generating section, a nip pad 74, an auxiliary heat generating section 80, and a stay 77 that supports the nip pad 74 and the auxiliary heat generating section 80. The press roller 61 is brought into contact with and separated from the fixing belt 60 by a moving section 90 explained below. The fuser 32 includes a thermistor 66 that detects the temperature of the fixing belt 60 and a thermostat 67 as a safety device that detects abnormal heat generation of the fuser 32.

Figure 4:
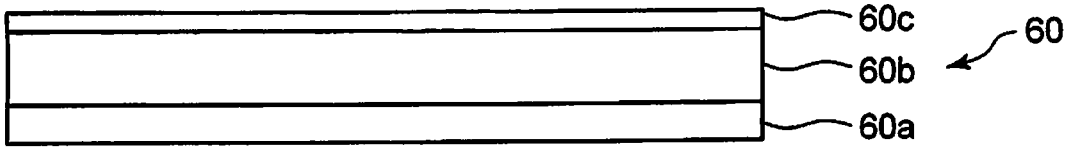
FIG. 4 is a schematic explanatory diagram of a layer configuration of a fixing belt in the first embodiment.

The fixing belt 60 is a cylindrical endless belt. The fixing belt 60 includes, for example, as shown in FIG. 4, a conductive layer 60*a*, an elastic layer 60*b*, and a surface release layer 60*c*. If an alternating current is applied to the IH coil 70, the conductive layer 60*a* inductively generates heat. The conductive layer 60*a* may be a single layer of, for example, nickel (Ni), copper (Cu), or stainless steel or may be a multilayer structure formed by laminating different members. The elastic layer 60*b* is formed of, for example, silicon rubber and improves fixability of the fuser 32. In the surface release layer 60*c*, fluorine resin such as PFA resin is used. However, the thicknesses of the elastic layer 60*b* and the release layer 60*c* are selected to prevent heat capacities thereof from becoming excessively large and reduce a warming-up time of the fuser 32.

For example, the press roller 61 includes a heat-resistant rubber layer 61*b* on the surface of a cored bar 61*a* and includes a release layer 61*c* formed of fluorine resin such as PFA resin on the surface of the rubber layer 61*b*.

Flanges 62 that support the ends of the fixing belt 60 fit within the inner diameter of the fixing belt 60 and keep the fixing belt 60 substantially circular. A motor 63 rotates the press roller 61 via a gear group 63*a*. The fixing belt 60 rotates following the press roller 61. The fixing belt 60 may rotate independently from the press roller 61.

The nip pad 74 presses the inner circumferential surface of the fixing belt 60 to the press roller 61 side and forms a nip 76 between the fixing belt 60 and the press roller 61. The nip pad 74 is formed of, for example, heat-resistant polyphenylene-sulfide resin (PPS), liquid crystal polymer (LCP), or phenolic resin (PF). For example, if a sheet having high slidability and high abrasion resistance is interposed or lubricant such as silicone oil is applied between the fixing belt 60 and the nip pad 74, frictional resistance between the fixing belt 60 and the nip pad 74 can be reduced.

The auxiliary heat generating section 80 includes a heat equalizing layer 82 incorporating heat pipes 81 and a metal plate 83 as an auxiliary heat generating layer. The auxiliary heat generating section 80 includes springs 87. The springs 87 adjust an arrangement position of the auxiliary heat generating section 80 to the inner circumferential direction of the fixing belt 60. The metal plate 83 has an arcuate shape patterned after the shape of the fixing belt 60. The heat equalizing layer is in contact with the metal plate 83. The heat equalizing layer 82 is bonded to the metal plate 83 using an adhesive having high thermal conductivity.

Figure 5:
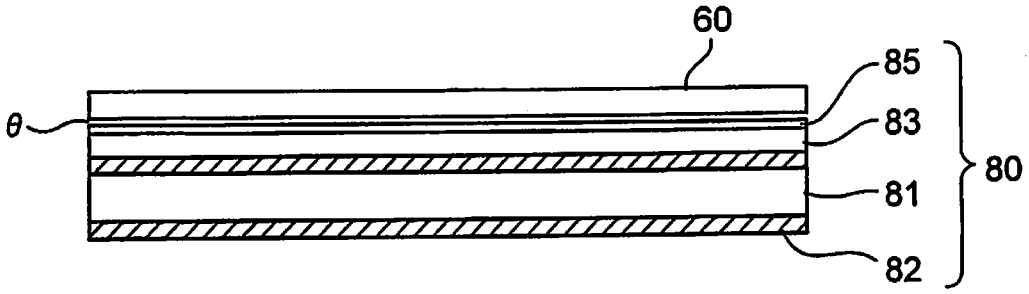
FIG. 5 is a schematic explanatory diagram of the fixing belt and an auxiliary heat generating section in the first embodiment.

As the metal plate 83, a magnetic member such as iron is used. The metal plate 83 generates an eddy-current with an induction current of the IH coil 70, inductively generates heat, and supports heat generation by the fixing belt 60. The auxiliary heat generating section 80 includes a fluorine-coated release layer 85 on a surface that slides against the fixing belt 60. As shown in FIG. 5, the auxiliary heat generating section 80 moves in the direction of the fixing belt 60 to come close to the fixing belt 60 while being a micro space θ apart from the fixing belt 60 or come into contact with the fixing belt 60.

Figure 6:
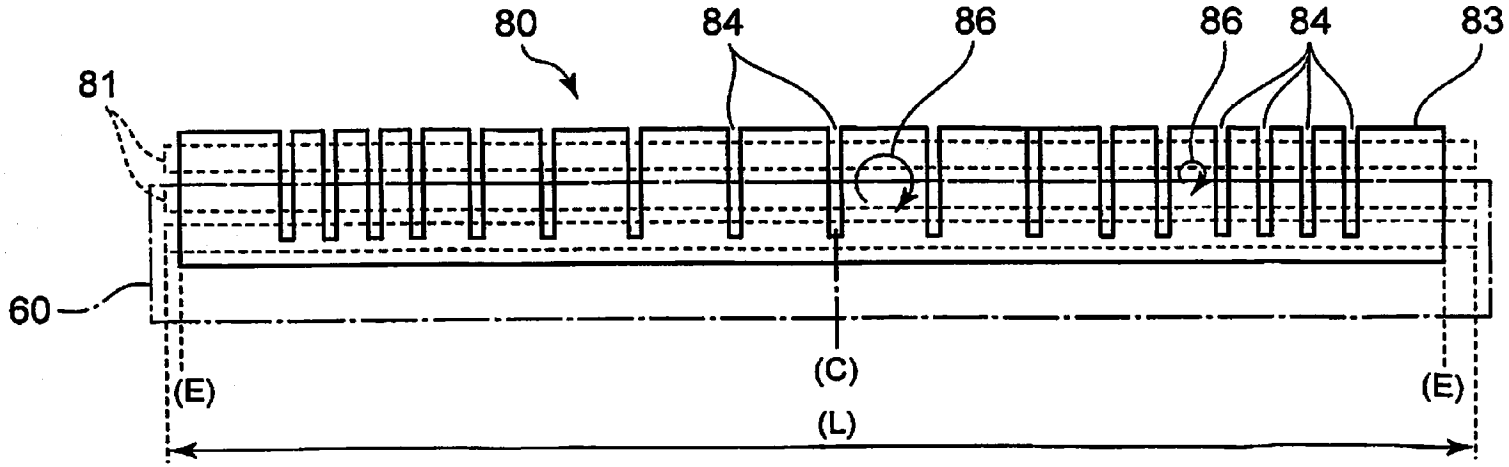
FIG. 6 is a schematic explanatory diagram of a metal plate in the first embodiment viewed from an arrow (V) direction of FIG. 2.

As shown in FIG. 6, the metal plate 83 includes slits 84 over the entire area of the metal plate 83. The slits 84 reduce an eddy-current 86 generated in the metal plate 83. The inductive heat generation of the metal plate 83 including the slits 84 is low compared with inductive heat generation of a metal plate without slits.

An interval of the slits 84 formed in the metal plate 83 is wide in the center (C) of the metal plate 83 and narrow at the ends (E) of the metal plate 83. The eddy-current 86 generated by the IH coil 70 is large in a center (C) peripheral area of the metal plate 83 compared with end (E) peripheral areas of the metal plate 83. In the center (C) peripheral area of the metal plate 83, the induction heat generation is also high and heat supply to the fixing belt 60 is large. In the end (E) peripheral areas of the metal plate 83, the eddy-current 86 generated by the IH coil 70 is small, the inductive heat generation is low, and the heat supply to the fixing belt 60 is small. By adjusting the interval of the slits 84, for example, in the case of continuous paper feeding, in a paper passing area of the center (C) peripheral area, a heat supply amount from the metal plate 83 to the fixing belt 60 is increased to maintain fixing temperature. In non-paper passing areas of the end (E) peripheral areas, heat of the fixing belt 60 is deprived by the metal plate 83 to suppress the temperature of the fixing belt 60 from rising too high.

Figure 7:
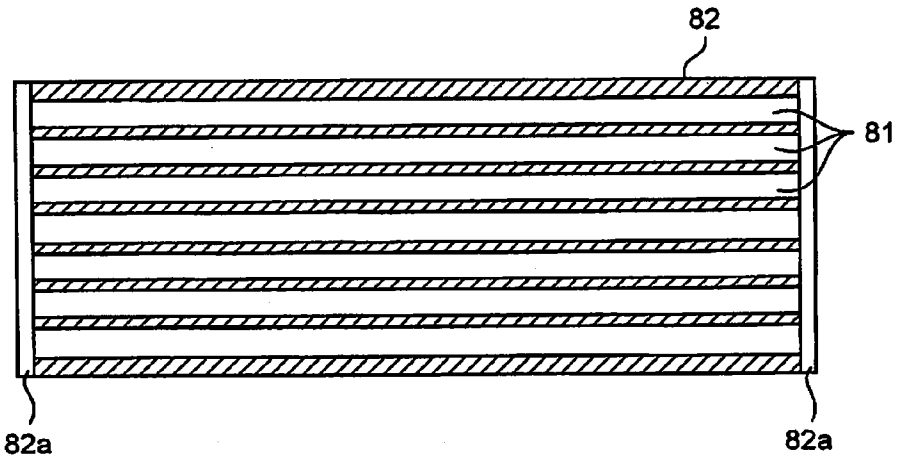
FIG. 7 is a schematic explanatory diagram of a heat equalizing layer incorporating heat pipes in the first embodiment.

The heat equalizing layer 82 equalizes the temperature in a longitudinal direction of the fixing belt 60 and the metal plate 83. The longitudinal direction is a direction orthogonal to an arrow "q" direction, which is a rotating direction of the fixing belt 60. As the heat equalizing layer 82, for example, a nonmagnetic and having high thermal conductivity material such as copper or aluminum is used. By using the nonmagnetic material as the heat equalizing layer 82, a magnetic field from the IH coil 70 is blocked not to penetrate through the magnetic plate 83 and reach the inside of the fixing belt 60. As shown in FIG. 7, the heat equalizing layer 82 incorporates plural heat pipes 81 formed by injecting a solvent such as water into hollow sections, which are formed by, for example, protrusion-molding an aluminum material, and sealing ends 82*a*. The hollow sections may be formed in the heat equalizing layer 82 by injection molding.

The heat pipes 81 are arranged in length (L) extending over an entire heating area of the fixing belt 60 in the longitudinal direction of the heat equalizing layer 82. The heat pipes 81 are arranged at equal intervals in the heat equalizing layer 82. The solvent of the heat pipes 81 has high thermal conductivity. The heat equalizing layer 82 equalizes the temperature of the entire area in the longitudinal direction of the auxiliary heat generating section 80.

The auxiliary heat generating section 80 including the heat equalizing layer 82 and the metal plate 83 is elastically supported by the stay 77 via the springs 87. The moving section 90 moves the auxiliary heat generating section 80 with respect to the fixing belt 60 in association with the movement of the press roller 61 with respect to the fixing belt 60.

Figure 8:
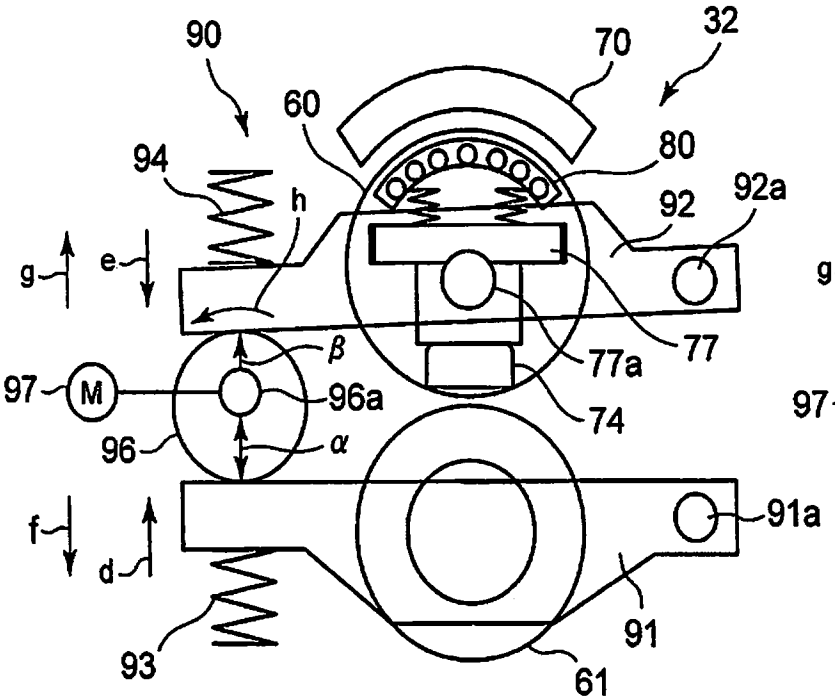
FIG. 8 is a schematic explanatory diagram for explaining separation of a press roller from the fixing belt in the first embodiment.

As shown in FIG. 8, the moving section 90 includes a roller arm 91 that supports a shaft 61*d* of the press roller 61 and a stay arm 92 that supports an end 77*a* of the stay 77. The roller arm 91 pivots about a shaft 91*a*. The stay arm 92 pivots about a shaft 92*a*. The moving section 90 includes a roller spring 93 and a stay spring 94. The roller spring 93 gives pivoting force in an arrow "d" direction to the roller arm 91. The stay spring 94 gives pivoting force in an arrow "e" direction to the stay arm 92. The moving section 90 includes a cam 96 rotated in an arrow "h" direction about a shaft 96*a* by a cam motor 97. The cam 96 causes the roller arm 91 to pivot in an arrow "f" direction resisting the roller spring 93 and causes the stay arm 92 to pivot in an arrow "g" direction resisting the stay spring 94.

The operation of the fuser 32 is explained.

While a power supply for the MFP 1 is off, the moving section 90 of the fuser 32 stops in a position where a long side α of the cam 96 is in contact with the roller arm 91 and a short side β of the cam 96 is in contact with the stay arm 92. As shown in FIG. 8, the press roller 61 separates from the fixing belt 60 resisting the roller spring 93. The auxiliary heat generating section 80 separates from the inner circumference of the fixing belt 60 with spring force of the stay spring 94.

Figure 10:
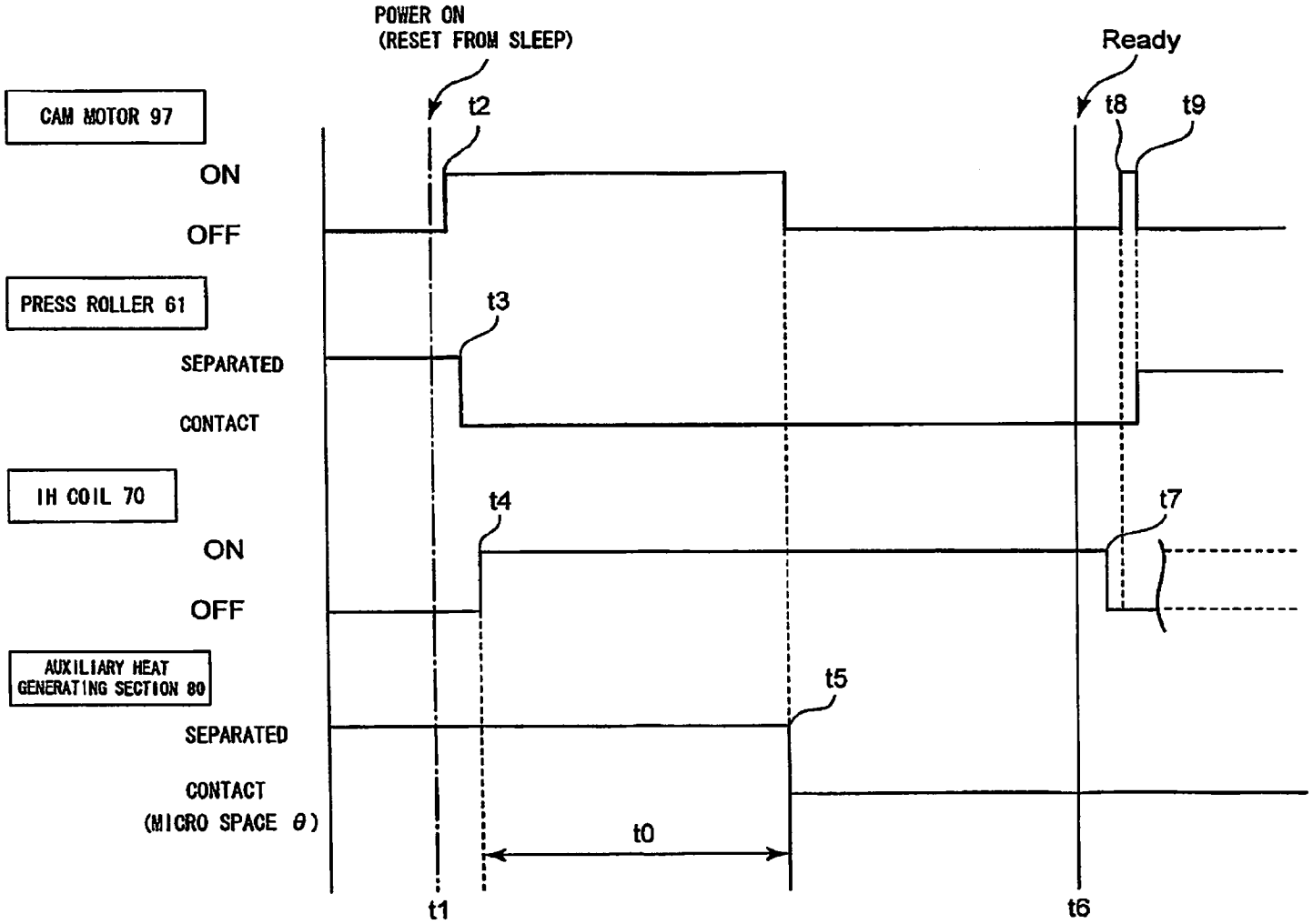
FIG. 10 is a timing chart of movement of the press roller and the auxiliary heat generating section during warming-up in the first embodiment.

As shown in FIG. 10, at time t1, if the power supply for the MFP 1 is turned on or the MFP 1 is reset from a sleep mode, the fuser 32 starts warming-up. At time t2, the CPU 100 turns on the motor 63 and the cam motor 97 to rotate the press roller 61 in an arrow "r" direction and rotate the cam 96 in the arrow "h" direction. The long side α of the cam 96 separates from the roller arm 91. The roller arm 91 is caused to pivot in the arrow "d" direction by the roller spring 93. At time t3, the press roller 61 comes into contact with the fixing belt 60 and forms the nip 76. The fixing belt 60 rotates in the arrow "q" direction following the press roller 61.

Figure 9:
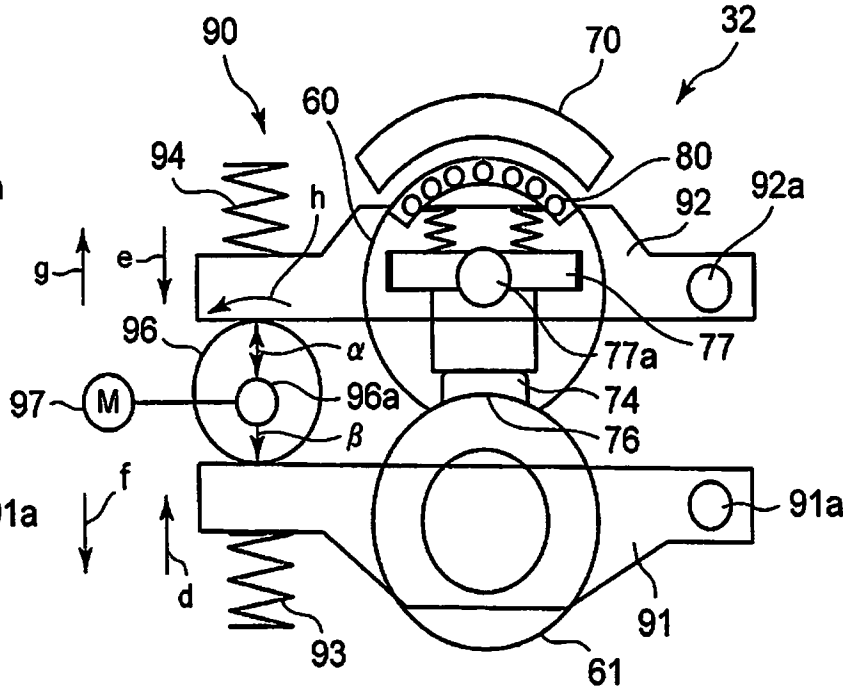
FIG. 9 is a schematic explanatory diagram for explaining contact of the press roller with the fixing belt in the first embodiment.

After the press roller 61 comes into contact with the fixing belt 60, at time t4, the CPU 100 turns on the IH coil 70 and starts heat generation of the fixing belt 60 and the metal plate 83. At time t5 when the cam 96 rotates a half turn, the CPU 100 turns off the cam motor 97 and stops the cam 96 in a position where the short side β is in contact with the roller arm 91 and the long side α is in contact with the stay arm 92. As shown in FIG. 9, the stay arm 92 rotates in the arrow "g" direction resisting the stay spring 94. The auxiliary heat generating section 80 moves in a direction toward the inner circumference of the fixing belt 60. The metal plate 83 of the auxiliary heat generating section 80 stops in a position where the metal plate 83 is close to the fixing belt 60 while being the micro space θ apart from the fixing belt 60.

If the fuser 32 reaches ready temperature at time t6, at time t7 and subsequent time, the CPU 100 controls the IH coil 70 to be turned on and off according to a detection result of the thermistor 66 and keeps the fixing belt 60 at the ready temperature. After turning on the cam motor 97 at time t8, at time t9, the CPU 100 turns off the cam motor 97 to turn the cam 96 to a ready position and stop the cam 96. The CPU 100 reduces pressurizing force of the press roller 61 in contact with the fixing belt 60 from pressurizing force in a warming-up mode to pressurizing force in a ready mode. The auxiliary heat generating section 80 maintains the micro space θ from the fixing belt 60.

After bringing the press roller 61 into contact with the fixing belt 60, the moving section 90 brings the auxiliary heat generating section 80 close to the fixing belt 60 through a time lag. During the warming-up, at time t4 when the CPU 100 turns on the IH coil 70 and starts the heat generation of the fixing belt 60 and the metal plate 83, the auxiliary heat generating section 80 is separated from the inner circumference of the fixing belt 60. During the start of the heat generation of the fixing belt 60 and the metal plate 83, the auxiliary heat generating section 80 suppresses the heat of the fixing belt 60 from being deprived because of the heat capacity of the auxiliary heat generating section 80 itself.

During a time lag t0 from time t4 when the heat generation of the fixing belt 60 and the metal plate 83 is started to time t5 when the auxiliary heat generating section 80 comes close to the fixing belt 60, the fuser 32 promotes the warming-up by the fixing belt 60 itself. Before time t5, the metal plate 83 generates heat with a magnetic flux from the IH coil 70 penetrated through the fixing belt 60. Heat generation in the end (E) peripheral areas of the metal plate 83 where the interval of the slits 84 is narrow is low compared with heat generation in the center (C) peripheral area where the interval of the slits is wide. At time t5, even if the auxiliary heat generating section 80 is brought close to the fixing belt 60, the auxiliary heat generating section 80 does not deprive the heat of the fixing belt 60. After the auxiliary heat generating section 80 is brought close to the fixing belt 60 at time t5, heat of the metal plate 83 is conducted to the fixing belt 60 via the micro space θ.

The fuser 32 separates the auxiliary heat generating section 80 from the fixing belt 60 and suppresses the auxiliary heat generating section 80 from depriving the heat of the fixing belt 60 before the auxiliary heat generating section 80 is heated. After the metal plate 83 is heated, the fuser 32 conducts the heat of the metal plate 83 to the fixing belt 60 to thereby reduce a warming-up time from power-on until the fuser 32 reaches the ready temperature. The time lag t0 can be adjusted by, for example, adjusting the rotating speed of the cam motor 97.

The fuser 32 can drive the press roller 61 and the auxiliary heat generating section 80 with the same mechanism and simplify a driving mechanism by associating the movement of the auxiliary heat generating section 80 with the movement of the press roller 61. Since the movement of the auxiliary heat generating section 80 is associated with the movement of the press roller 61, adjustment of the time lag t0 is easy, the warming-up time can be more properly reduced, and the speed of the MFP 1 is increased.

When the MFP 1 starts print, the fuser 32 turns on the cam motor 97 and stops the cam 96 in the position where the short side β is in contact with the roller arm 91 and the long side α is in contact with the stay arm 92. The fuser 32 increases the pressurizing force of the press roller 61 in contact with the fixing belt 60 from the pressurizing force in the ready mode to pressurizing force of a print mode. The fuser 32 controls the fixing belt 60 to the fixing temperature, holds the sheet P having toner images with the nip 76, conveys the sheet P in an arrow "t" direction, and heats and pressurizes the sheet P to fix the toner images on the sheet P.

Although the heat capacity of the fixing belt 60 is small, the fixing belt 60 obtains a heat quantity sufficient for subjecting the sheet P to fixing from heat directly generated by a magnetic flux of the IH coil 70 and heat conducted from the metal plate 83.

During fixing, since the heat capacity of the fixing belt 60 is small, the temperature of the fixing belt 60 drops in the paper passing area of the fixing belt 60. In the metal plate 83, the temperature of an area opposed to the paper passing area drops because of the heat conduction to the fixing belt 60. The heat pipes 81 conduct the heat of the non-paper passing areas of the metal plate 83 to the paper passing area via the heat equalizing layer 82 and suppress the temperature of the paper passing area of the metal plate 83 from dropping. The heat pipes 81 equalize the temperature of the metal plate 83 and equalize the temperature of the fixing belt 60. In the high-speed MFP 1, since the heat capacity of the fixing belt 60 is extremely small, in some case, during continuous printing, heat supply by the fixing belt 60 cannot keep up with printing. The temperature drop during the high-speed continuous printing is prevented by bringing the auxiliary heat generating section 80 close to the fixing belt 60 and increasing the heat capacity of a fixing area.

While fixing is performed, the heat conduction from the metal plate 83 to the fixing belt 60 is smoothly performed to prevent the print mode from being kept waiting because of temperature insufficiency in the paper passing area of the fixing belt 60.

When the sheet P has a small size, if the fixing operation is continued, temperature drops in the paper passing area of the fixing belt 60 and temperature gradually rises in the non-paper passing areas of the fixing belt 60. In the area opposed to the paper passing area, the metal plate 83 conducts heat in a direction in which the heat of the metal plate 83 is given to the fixing belt 60. In areas opposed to the non-paper passing areas, the metal plate 83 conducts heat in a direction in which the heat of the fixing belt 60 is given to the metal plate 83.

Since a heat generation amount is small in the peripheral areas of the ends (E) of the metal plate 83 opposed to the non-paper passing areas of the fixing belt 60, the heat of the non-paper passing areas of the fixing belt 60 is smoothly transferred to the metal plate 83. The heat pipes 81 transport, via the heat equalizing layer 82, the heat in the end (E) areas of the metal plate 83 where the temperature rises to the center (C) area where the temperature drops and equalize the temperature of the metal plate 83.

While the fixing operation is continuously performed, the heat conduction from the center (C) area of the metal plate 83 to the fixing belt 60 is promoted and the heat conduction from the fixing belt 60 to the end (E) areas of the metal plate 83 is promoted. The print mode is prevented from being kept waiting because of temperature insufficiency in the paper passing area of the fixing belt 60 or overheat in the non-paper passing areas.

After ending the print, the CPU 100 keeps the fixing belt 60 at the ready temperature and reduces the pressurizing force of the press roller 61 in contact with the fixing belt 60 to the pressurizing force in the ready mode. Further, if the MFP 1 changes to the sleep mode or the power supply is turned off, the CPU 100 stops the MFP 1 after rotating the cam 96 to a position shown in FIG. 8 using the cam motor 97. The press roller 61 separates from the fixing belt 60 and the auxiliary heat generating section 80 separates from the fixing belt 60.

During driving of the fuser 32, for example, if the fixing belt 60 or the metal plate 83 abnormally generates heat, the thermostat 67 acts and cuts off power supply to the IH coil 70.

According to the first embodiment, in the warming-up mode, the auxiliary heat generating section 80 is separated from the fixing belt 60 before the metal plate is heated. If the metal plate 83 is heated, the auxiliary heat generating section 80 is brought close to the fixing belt 60. During the start of the warming-up of the fuser 32, the temperature of the fixing belt 60 is prevented from dropping because of the heat capacity of the auxiliary heat generating section 80. After the temperature of the auxiliary heat generating section 80 rises, the fixing belt 60 is heated by the metal plate 83 to reduce the warming-up time.

According to the first embodiment, in the print mode, heat is conducted from the metal plate 83 to the fixing belt 60 to prevent the print mode from being kept waiting because of temperature insufficiency in the paper passing area. Alternatively, heat is conducted from the fixing belt 60 to the metal plate 83 to prevent the print mode from being kept waiting because of overheat in the non-paper passing areas. According to the first embodiment, since the movement of the auxiliary heat generating section 80 is associated with the movement of the press roller 61, it is possible to easily adjust the time lag t0 and more properly reduce the warming-up time.

Second Embodiment

A second embodiment is explained. In the second embodiment, the heat equalizing layer in the first embodiment is formed of a magnetic material. The heat equalizing layer functions as an auxiliary heat generating layer as well. In the second embodiment, components same as the components explained in the first embodiment are denoted by the same reference numerals and signs and detailed explanation of the components is omitted.

Figure 11:
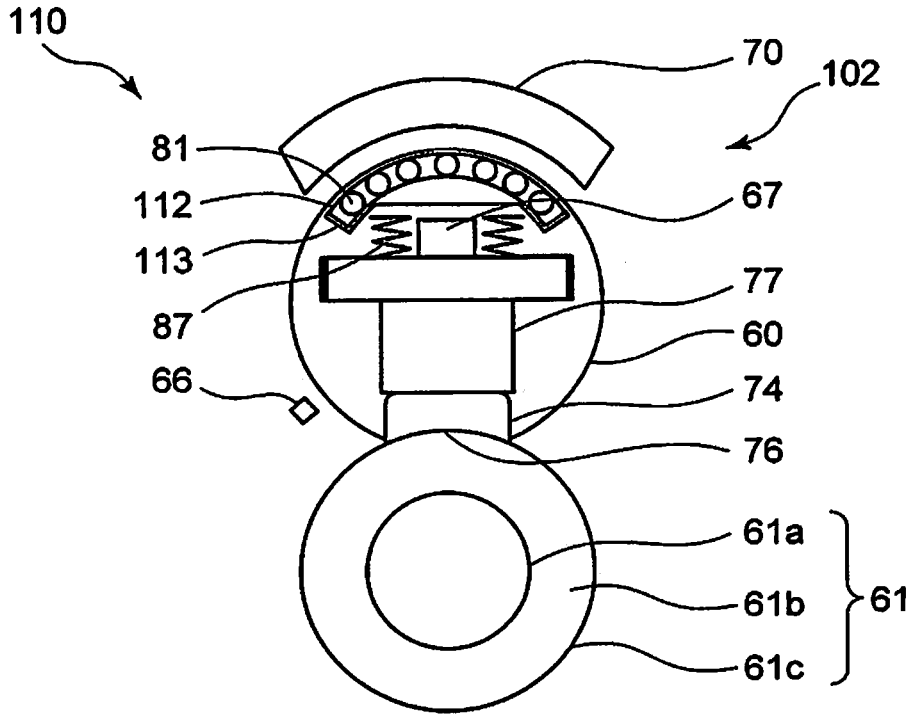
FIG. 11 is a schematic configuration diagram of a fuser according to a second embodiment viewed from a side.
Figure 12:
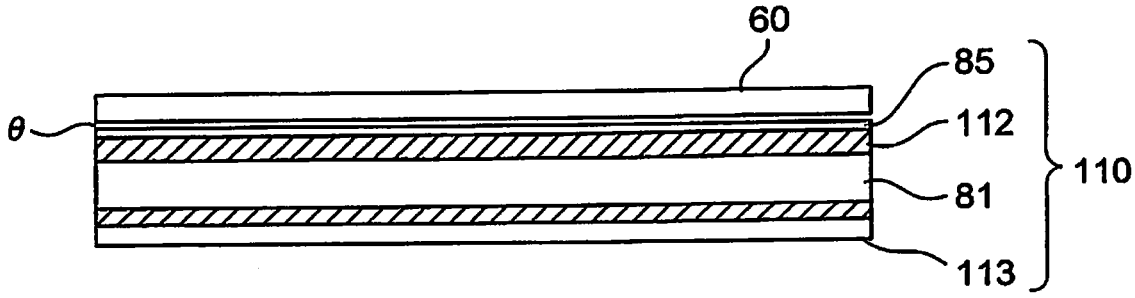
FIG. 12 is a schematic explanatory diagram of a fixing belt and an auxiliary heat generating section in the second embodiment.

As shown in FIG. 11, in an auxiliary heat generating section 110 of a fuser 102 according to the second embodiment, a heat equalizing layer 112 incorporating the heat pipes 81 is formed of iron (Fe), which is a magnetic material. The heat equalizing layer 112 functions as an auxiliary heat generating layer, which generates heat with a magnetic flux of the IH coil 70, as well. The heat equalizing layer 112 of the auxiliary heat generating section 110 includes a shield plate 113 made of aluminum that blocks a magnetic flux from the IH coil 70 not to reach the inside of the fixing belt 60. The heat pipes 81 are formed by, for example, sealing a solvent in hollow sections, which are formed by protrusion-molding the heat equalizing layer 112 made of iron.

After the press roller 61 is brought into contact with the fixing belt 60 at time t3, when the IH coil 70 is turned on at time t4, the fixing belt 60 and the heat equalizing layer 112 generate heat. At time t4, the auxiliary heat generating section 110 is separated from the inner circumference of the fixing belt 60. During the start of the heat generation of the fixing belt 60 and the heat equalizing layer 112, the auxiliary heat generating section 110 suppresses the heat quantity of the fixing belt 60 from being deprived because of the heat capacity of the auxiliary heat generating section 110 itself.

At time t5, the heat equalizing layer 112 of the auxiliary heat generating section 110 comes close to the fixing belt 60 while being the micro space θ apart from the fixing belt 60. The fuser 102 promotes the warming-up by the fixing belt 60 itself during the time lag t0 from time t4 when the heat generation of the fixing belt 60 and the heat equalizing layer 112 is started until time t5 when the auxiliary heat generating section 110 comes close to the fixing belt 60. Before time t5, the heat equalizing layer 112 generates heat with a magnetic flux from the IH coil 70 penetrated through the fixing belt 60. At time t5, the auxiliary heat generating section 110 does not deprive the heat quantity of the fixing belt 60 even if the auxiliary heat generating section 110 comes close to the fixing belt 60. After the auxiliary heat generating section 110 comes close to the fixing belt 60, the heat of the heat equalizing layer 112 is conducted to the fixing belt 60 via the micro space θ.

The fuser 102 separates from the fixing belt 60 and suppresses the auxiliary heat generating section 110 from depriving the heat of the fixing belt 60 before the heat equalizing layer 112 is heated. After the heat equalizing layer 112 is heated, the fuser 102 conducts the heat of the heat equalizing layer 112 to the fixing belt 60 to thereby reduce the warming-up time from the power-on until the fuser 102 reaches the ready temperature.

During the print mode, the fixing belt 60 obtains a heat quantity sufficient for subjecting the sheet P to fixing from heat directly generated by a magnetic flux of the IH coil 70 and heat conducted from the heat equalizing layer 112. If the temperature of the heat equalizing layer 112 opposed to the paper passing area drops because of the heat conduction to the fixing belt 60, the heat pipes 81 transport the heat in the end (E) areas of the heat equalizing layer 112 to the center (C) area to equalize the temperature of the heat equalizing layer 112 and equalize the temperature of the fixing belt 60. The heat conduction from the heat equalizing layer 112 to the fixing belt 60 is smoothly performed to prevent the print mode from being kept waiting because of temperature insufficiency in the paper passing area of the fixing belt 60.

If the fixing operation for the small-size sheet P is continued, temperature drops in the paper passing area of the fixing belt 60 and temperature gradually rises in the non-paper passing areas of the fixing belt 60. In the paper passing area, the fuser 102 conducts heat in a direction in which the heat of the heat equalizing layer 112 is given to the fixing belt 60. In the non-paper passing areas, the fuser 102 conducts heat in a direction in which the heat of the fixing belt 60 is given to the heat equalizing layer 112. The fuser 102 prevents the print mode from being kept waiting because of temperature insufficiency in the paper passing area of the fixing belt 60 or overheat in the non-paper passing areas.

According to the second embodiment, in the warming-up mode, the auxiliary heat generating section 110 is separated from the fixing belt 60 before the heat equalizing layer 112 is heated. If the heat equalizing layer 112 is heated, the auxiliary heat generating section 110 is brought close to the fixing belt 60. During the start of the warming-up of the fuser 102, the temperature of the fixing belt 60 is prevented from dropping because of the heat capacity of the auxiliary heat generating section 110. After the temperature of the auxiliary heat generating section 110 rises, the fixing belt 60 is heated by the heat equalizing layer 112 to reduce the warming-up time.

According to the second embodiment, in the print mode, the fuser 102 conducts heat from the heat equalizing layer 112 to the fixing belt 60 to prevent the MFP 1 from being kept waiting because of temperature insufficiency in the paper passing area. Alternatively, the fuser 102 conducts heat from the fixing belt 60 to the heat equalizing layer 112 to prevent the MFP 1 from being kept waiting because of overheat in the non-paper passing areas. As in the first embodiment, since the movement of the auxiliary heat generating section 110 is associated with the movement of the press roller 61, the time lag t0 can be easily adjusted and the warming-up time can be more properly reduced.

Third Embodiment

A third embodiment is explained. In the third embodiment, an auxiliary heat generating layer by nickel plating is formed on the surface of a nonmagnetic heat equalizing layer instead of the metal plate in the first embodiment. In the third embodiment, components same as the components explained in the first embodiment are denoted by the same reference numerals and signs and detailed explanation of the components is omitted.

Figure 13:
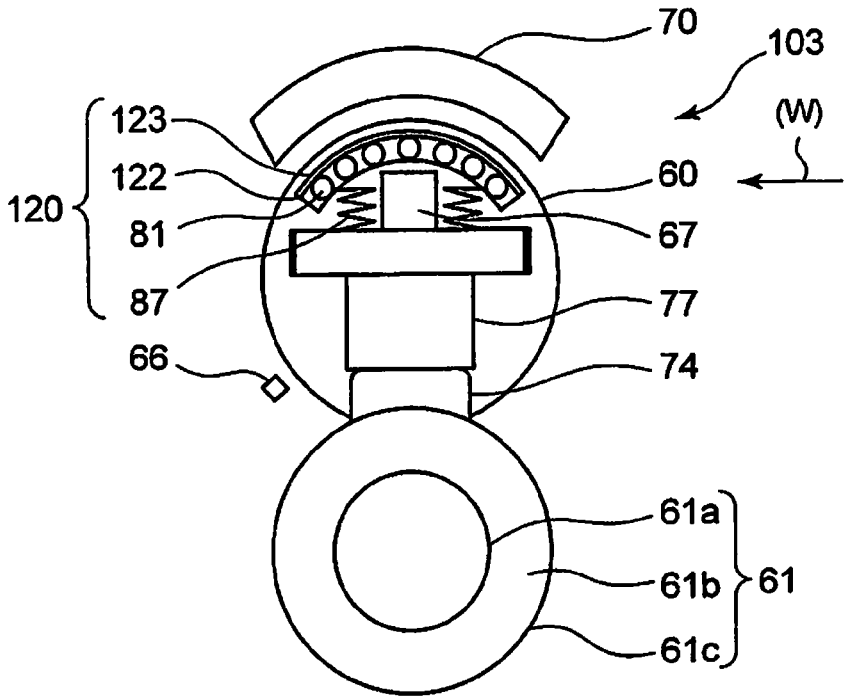
FIG. 13 is a schematic configuration diagram of a fuser according to a third embodiment viewed from a side.
Figure 14:
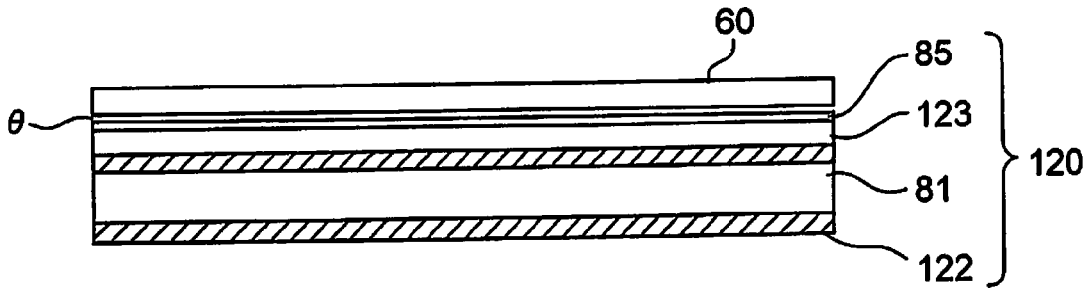
FIG. 14 is a schematic explanatory diagram of a fixing belt and an auxiliary heat generating section in the third embodiment.

As shown in FIGS. 13 and 14, an auxiliary heat generating section 120 of a fuser 103 according to the third embodiment includes a nickel plating layer 123 as an auxiliary heat generating layer, on the surface on the fixing belt 60 side of a heat equalizing layer 122 made of aluminum incorporating the heat pipes 81. The nickel plating layer 123 is directly formed by plating in the heat equalizing layer 122. The heat pipes 81 are formed by sealing a solvent in hollow sections, which are formed by protrusion-molding the heat equalizing layer 122.

Figure 15:
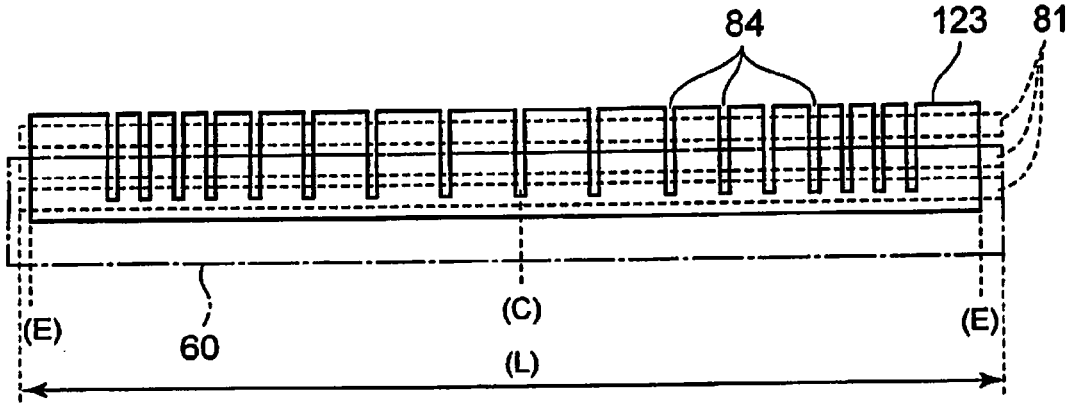
FIG. 15 is a schematic explanatory diagram of a nickel plating layer viewed from an arrow (W) direction in FIG. 13 in the third embodiment.

In the nickel plating layer 123, as shown in FIG. 15, the slits 84 are formed over the entire area. The slits 84 are simultaneously formed when the nickel plating layer 123 is formed. Inductive heat generation of the nickel plating layer 123 is reduced by the slits 84. An interval of the slits 84 of the nickel plating layer 123 is wide in the center (C) and narrow at the ends (E). Inductive heat generation in end (E) peripheral areas of the nickel plating layer 123 is suppressed compared with inductive heat generation in a center (C) peripheral area of the nickel plating layer 123.

After the press roller 61 is brought into contact with the fixing belt 60 at time t3, when the IH coil 70 is turned on at time t4, the fixing belt 60 and the nickel plating layer 123 generate heat. At time t4, the auxiliary heat generating section 120 is separated from the inner circumference of the fixing belt 60. During the start of the heat generation of the fixing belt 60 and the nickel plating layer 123, the auxiliary heat generating section 120 suppresses the heat quantity of the fixing belt 60 from being deprived because of the heat capacity of the auxiliary heat generating section 120 itself.

At time t5, the nickel plating layer 123 of the auxiliary heat generating section 120 comes close to the fixing belt 60 while being the micro space θ apart from the fixing belt 60. The fuser 103 promotes the warming-up by the fixing belt 60 itself during the time lag t0 from time t4 when the heat generation of the fixing belt 60 and the nickel plating layer 123 is started until time t5 when the auxiliary heat generating section 120 comes close to the fixing belt 60. Before time t5, the nickel plating layer 123 generates heat with a magnetic flux from the IH coil 70 penetrated through the fixing belt 60. At time t5, the auxiliary heat generating section 120 does not deprive the heat quantity of the fixing belt 60 even if the auxiliary heat generating section 120 comes close to the fixing belt 60. After the auxiliary heat generating section 120 comes close to the fixing belt 60, the heat of the nickel plating layer 123 is conducted to the fixing belt 60 via the micro space θ.

The fuser 103 separates from the fixing belt 60 and suppresses the auxiliary heat generating section 120 from depriving the heat of the fixing belt 60 before the nickel plating layer 123 is heated. After the nickel plating layer 123 is heated, the fuser 103 conducts the heat of the nickel plating layer 123 to the fixing belt 60 to thereby reduce the warming-up time from the power-on until the fuser 103 reaches the ready temperature.

During the print mode, the fixing belt 60 obtains a heat quantity sufficient for subjecting the sheet P to fixing from heat directly generated by a magnetic flux of the IH coil 70 and heat conducted from the nickel plating layer 123. If the temperature of the nickel plating layer 123 in the center (C) area drops because of the heat conduction to the fixing belt 60, the heat pipes 81 transport the heat in the end (E) areas of the heat equalizing layer 122 to the paper passing area to equalize the temperature of the heat equalizing layer 122 and equalize the temperature of the fixing belt 60. The heat conduction from the nickel plating layer 123 to the fixing belt 60 is smoothly performed to prevent the print mode from being kept waiting because of temperature insufficiency in the paper passing area of the fixing belt 60.

If the fixing operation for the small-size sheet P is continued, temperature drops in the paper passing area of the fixing belt 60 and temperature gradually rises in the non-paper passing areas of the fixing belt 60. In the paper passing area, the fuser 103 conducts heat in a direction in which the heat of the nickel plating layer 123 is given to the fixing belt 60. In the non-paper passing areas, the fuser 103 conducts heat in a direction in which the heat of the fixing belt 60 is given to the nickel plating layer 123.

The nickel plating layer 123 has a small heat generation amount in the end (E) peripheral areas where the interval of the slits 84 is small. The heat of the non-paper passing areas of the fixing belt 60 is smoothly transferred to the nickel plating layer 123. The heat pipes 81 transport, via the heat equalizing layer 122, the heat of the end (E) areas of the nickel plating layer 123 where temperature rises to the center (C) area where temperature drops and equalize the temperature of the nickel plating layer 123. While the fuser 103 continuously performs the fixing operation, the fuser 103 promotes the heat conduction from the nickel plating layer 123 to the fixing belt 60 in the paper passing area and promotes the heat conduction from the fixing belt 60 to the nickel plating layer 123 in the non-paper passing areas. The fuser 103 prevents the print mode from being kept waiting because of temperature insufficiency in the paper passing area of the fixing belt 60 and overheat in the non-paper passing areas.

According to the third embodiment, in the warming-up mode, the auxiliary heat generating section 120 is separated from the fixing belt 60 before the nickel plating layer 123 is heated. If the nickel plating layer 123 is heated, the auxiliary heat generating section 120 is brought close to the fixing belt 60. During the start of the warming-up of the fuser 103, the temperature of the fixing belt 60 is prevented from dropping because of the heat capacity of the auxiliary heat generating section 120. After the temperature of the auxiliary heat generating section 120 rises, the fixing belt 60 is heated by the nickel plating layer 123 to reduce the warming-up time.

According to the third embodiment, in the print mode, the fuser 103 conducts heat from the nickel plating layer 123 to the fixing belt 60 and prevents the print mode from being kept waiting because of temperature insufficiency in the paper passing area. Alternatively, the fuser 103 conducts heat from the fixing belt 60 to the nickel plating layer 123 and prevents the print mode from being kept waiting because of overheat in the non-paper passing areas. As in the first embodiment, since the movement of the auxiliary heat generating section 120 is associated with the movement of the press roller 61, the time lag t0 can be easily adjusted and the warming-up time can be more properly reduced.

Fourth Embodiment

A fourth embodiment is explained. The fourth embodiment is different from the first embodiment in a moving section and the arrangement of a thermostat. The moving section in the fourth embodiment moves an auxiliary heat generating section independently from the movement of a press roller. In the fourth embodiment, components same as the components explained in the first embodiment are denoted by the same reference numerals and signs and detailed explanation of the components is omitted.

Figure 17:
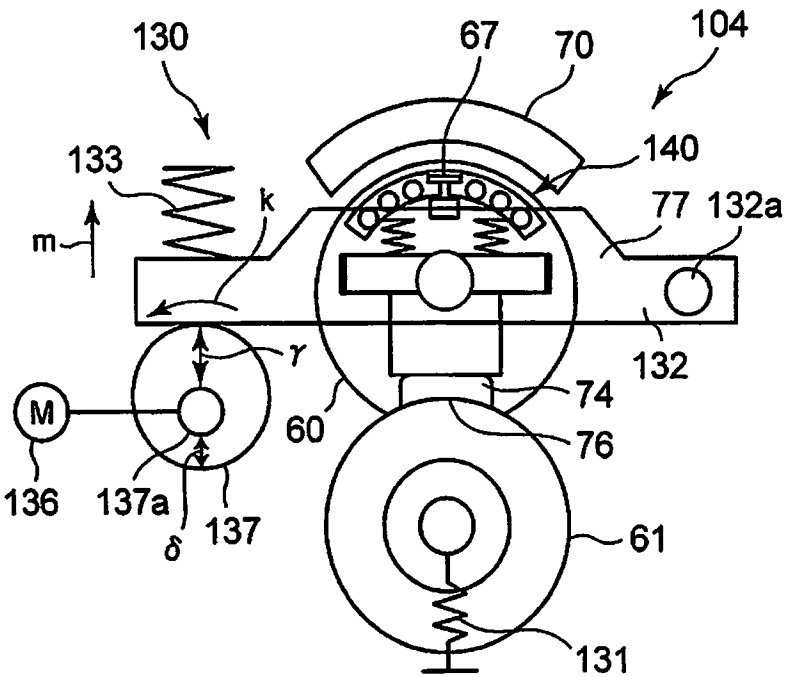
FIG. 17 is a schematic explanatory diagram for explaining closeness of the auxiliary heat generating section to the fixing belt in a fourth embodiment.
Figure 16:
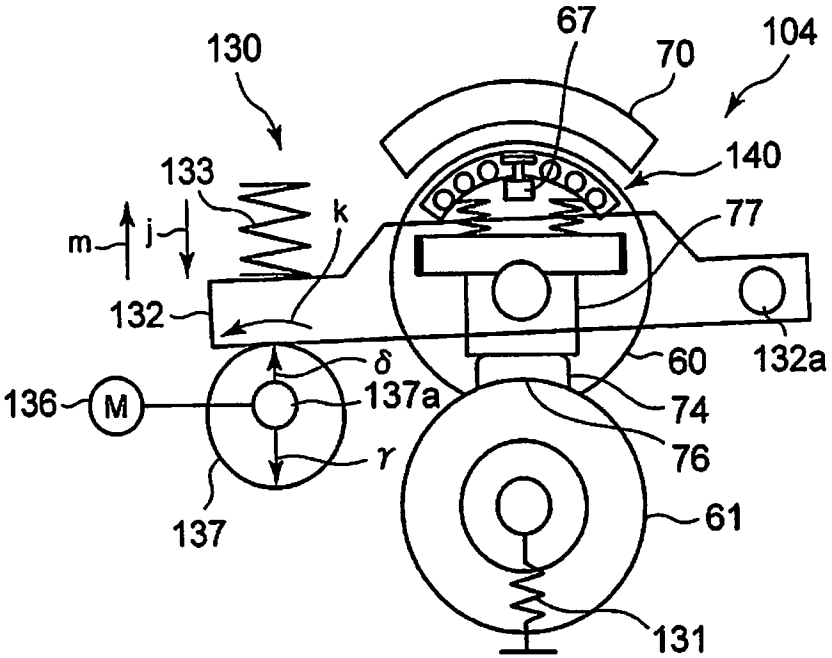
FIG. 16 is a schematic explanatory diagram for explaining separation of an auxiliary heat generating section from a fixing belt in a fourth embodiment.

As shown in FIGS. 16 and 17, a moving section 130 of a fuser 104 according to the fourth embodiment moves an auxiliary heat generating section 140 with respect to the fixing belt 60. A press-roller moving section 131 moves the press roller 61 with respect to the fixing belt 60. The moving section 130 includes a stay arm 132 that supports the stay 77. The stay arm 132 pivots about a shaft 132*a*. The moving section 130 includes a stay spring 133 that gives pivoting force in an arrow "j" direction to the stay arm 132.

The moving section 130 includes a cam 137 rotated in an arrow "k" direction about a shaft 137*a* by a cam motor 136. The cam 137 causes the stay arm 132 to pivot in an arrow "m" direction resisting the stay spring 133.

While the power supply for the MFP 1 is off, a short side δ of the cam 137 is present in a position where the short side δ is in contact with the stay arm 132. As shown in FIG. 16, the auxiliary heat generating section 140 is separated from the inner circumference of the fixing belt 60 by spring force of the stay spring 133. At time t1, if the power supply for the MFP 1 is turned on or the MFP 1 is reset from the sleep mode, at time t2, the CPU 100 drives the press-roller moving section 131 and the cam motor 136. At time t5 when the cam 137 rotates a half turn in the arrow "k" direction, the CPU 100 turns off the cam motor 136. From time t2 to time t5, the press roller 61 comes into contact with the fixing belt 60 and forms the nip 76 at time t3 and starts heat generation of the fixing belt 60 and the metal plate 83 at time t4.

At time t5, a long side γ of the cam 137 comes into contact with the stay arm 132. As shown in FIG. 17, the stay arm 132 brings the auxiliary heat generating section 140 close to the fixing belt 60 resisting the stay spring 133. If the fuser 104 reaches the ready temperature at time t6, the CPU 100 drives the press-roller moving section 131 according to a mode of the MFP 1 and adjusts pressurizing force of the press roller 61 that comes into contact with the fixing belt 60.

From time t4 to time t5, the fuser 104 separates the auxiliary heat generating section 140 from the inner circumference of the fixing belt 60, suppresses the auxiliary heat generating section 140 from depriving the heat of the fixing belt 60 because of the heat capacity of the auxiliary heat generating section 140 itself, and promotes the warming-up by the fixing belt 60 itself. The metal plate 83 generates heat to be heated before time t5. After the auxiliary heat generating section 140 comes close to the fixing belt 60, the auxiliary heat generating section 140 conducts the heat of the metal plate 83 to the fixing belt 60 via the micro space θ and promotes the warming-up of the fixing belt 60.

The time lag t0 from time t4 to time t5 can be changed by, for example, adjusting the rotating speed of the cam motor 136. Further, the width of the time lag t0 can be changed by adjusting timing for the start of driving of the press-roller moving section 131 and timing for the start of driving of the cam motor 136.

If the MFP 1 changes to the sleep mode or the power supply is turned off, the CPU 100 drives the press-roller moving section 131 and the cam motor 136, separates the auxiliary heat generating section 140 from the fixing belt 60, separates the press roller 61 from the fixing belt 60, and stops the MFP 1.

Figure 18:
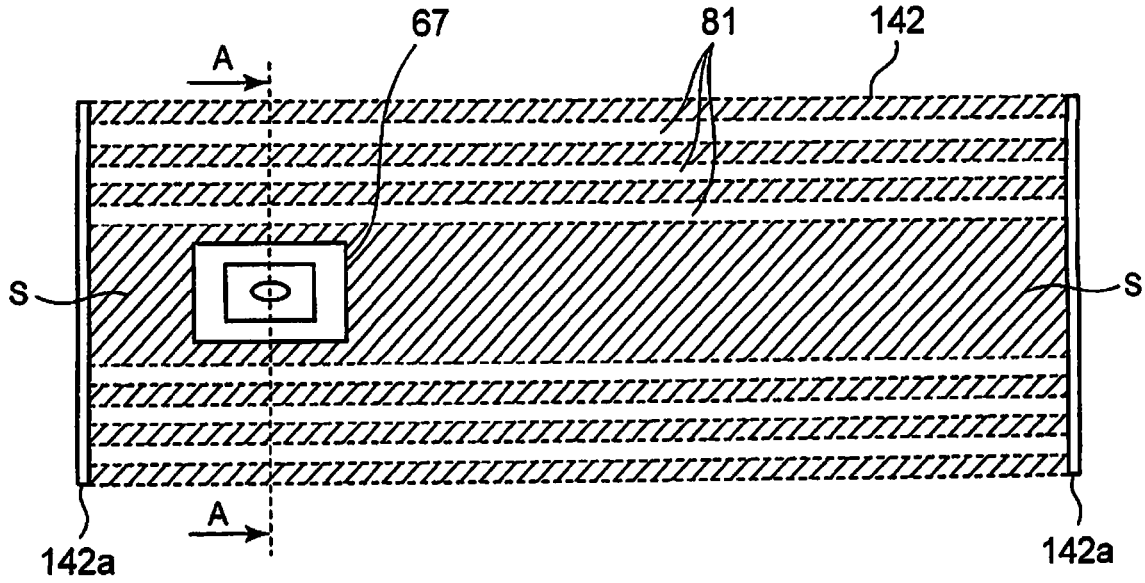
FIG. 18 is a schematic explanatory diagram of a heat equalizing layer in the fourth embodiment.
Figure 19:
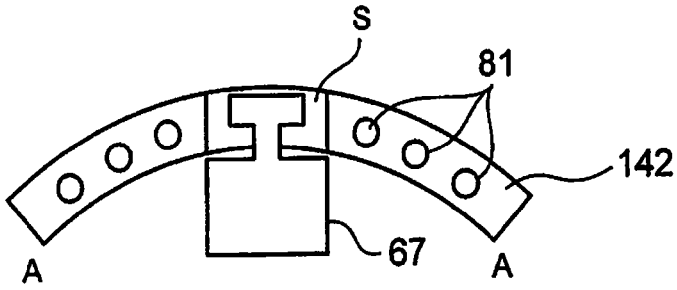
FIG. 19 is a schematic explanatory diagram of the heat equalizing layer and a thermostat viewed from an arrow A-A direction in FIG. 18 in the fourth embodiment.

The thermostat 67 that detects abnormal heat generation of the fixing belt 60 or the metal plate 83 is attached to the auxiliary heat generating section 140. The thermostat 67 is set close to the fixing belt 60 and the metal plate 83 to detect abnormal heat generation in a short time. As shown in FIGS. 18 and 19, a part of the thermostat 67 is embedded in a heat equalizing layer 142 of the auxiliary heat generating section 140.

As shown in FIG. 18, the heat equalizing layer 142 made of an aluminum material of the auxiliary heat generating section 140 incorporates the plural heat pipes 81 formed by injecting a solvent into hollow sections, which are formed by protrusion-molding the aluminum material, and sealing ends 142*a*. The heat equalizing layer 142 incorporates the heat pipes 81 at equal intervals on both the sides avoiding an area (S) where the thermostat 67 is attached. In the area of the heat equalizing layer 142 where the thermostat 67 is attached, the arrangement interval of the heat pipes 81 is widened to prevent heat equalization by the heat pips 81 from affecting the thermostat 67. The thermostat 67 detects abnormality of the fuser 104 without being affected by the heat equalization by the heat pipes 81.

Figure 20:
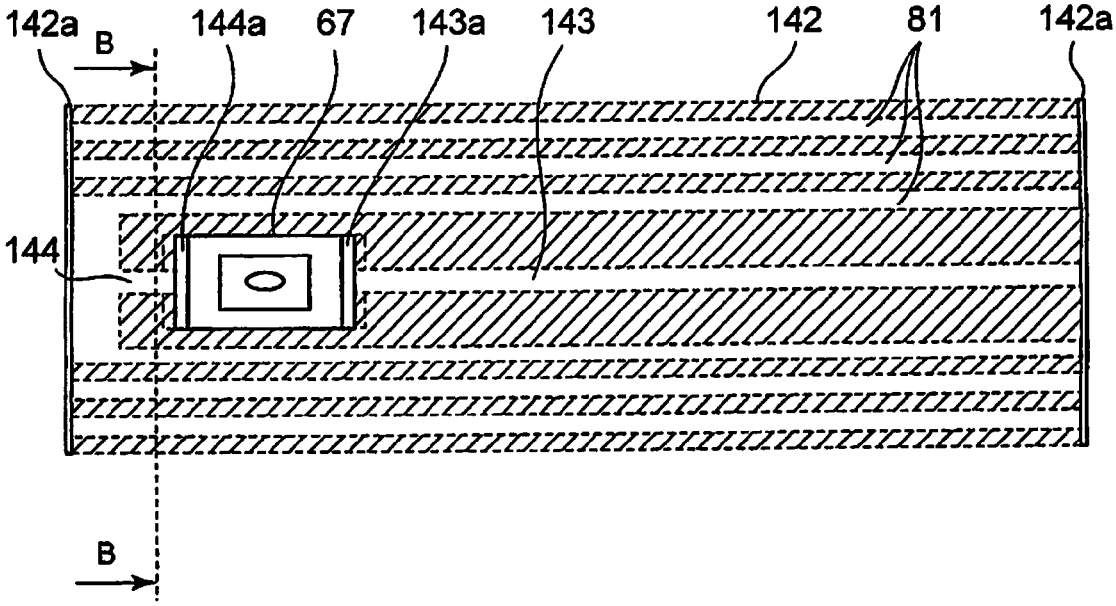
FIG. 20 is a schematic explanatory diagram of a heat equalizing layer in a modification of the fourth embodiment.
Figure 21:
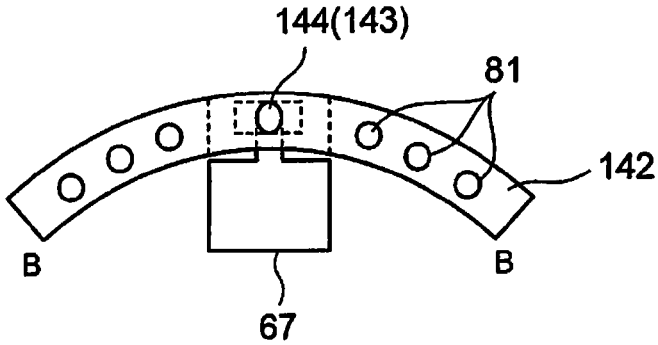
FIG. 21 is a schematic explanatory diagram of the heat equalizing layer and a thermostat viewed from an arrow B-B direction in FIG. 20 in the modification of the fourth embodiment.

As in a modification shown in FIGS. 20 and 21, the heat equalizing layer 142 may incorporate heat pipes 143 and 144 in the area (S). In the modification, heat pipes are provided except a space of the area (S) in which the thermostat 67 is embedded. The heat equalizing layer 142 incorporates, in the longitudinal direction, the heat pipes 143 and 144 on both the sides of the space in which the thermostat 67 is embedded.

The heat pipe 143 is formed by protrusion-molding the aluminum material, injecting a solvent into the aluminum material, and sealing the ends 142*a* of the heat equalizing layer 142 and an attachment position side end 143*a* of the thermostat 67. The heat pipe 144 is formed by protrusion-molding the aluminum material, injecting the solvent into the aluminum material, and sealing the ends 142*a* of the heat equalizing layer 142 and an attachment position side end 144*a* of the thermostat 67. Since the heat pipes 143 and 144 are incorporated, the heat equalizing layer 142 can equalize temperature in the area (S) as well and improve heat equalization performance.

According to the fourth embodiment, in the warming-up mode, the auxiliary heat generating section 140 is separated from the fixing belt 60 before the metal plate is heated. If the metal plate 83 is heated, the auxiliary heat generating section 140 is brought close to the fixing belt 60. During the start of the warming-up of the fuser 104, the temperature of the fixing belt 60 is prevented from dropping because of the heat capacity of the auxiliary heat generating section 140. After the temperature of the auxiliary heat generating section 140 rises, the fixing belt 60 is heated by the heat equalizing layer 142 to reduce the warming-up time. As in the first embodiment, the MFP 1 is prevented from being kept waiting because of temperature insufficiency in the paper passing area or overheat in the non-paper passing areas.

According to the fourth embodiment, the thermostat 67 is attached to the heat equalizing layer 142 and set close to the fixing belt 60 and the metal plate 83. The heat equalizing layer 142 incorporates the heat pipes 81 avoiding the attachment position of the thermostat 67. The thermostat 67 is not affected by the heat equalization by the heat pipes 81 and reduces a detection time for abnormal heat generation of the fuser 104.

Fifth Embodiment

A fifth embodiment is explained. The fifth embodiment is different from the first embodiment in the structure of a fuser. In the fifth embodiment, components same as the components explained in the first embodiment are denoted by the same reference numerals and signs and detailed explanation of the components is omitted.

Figure 22:
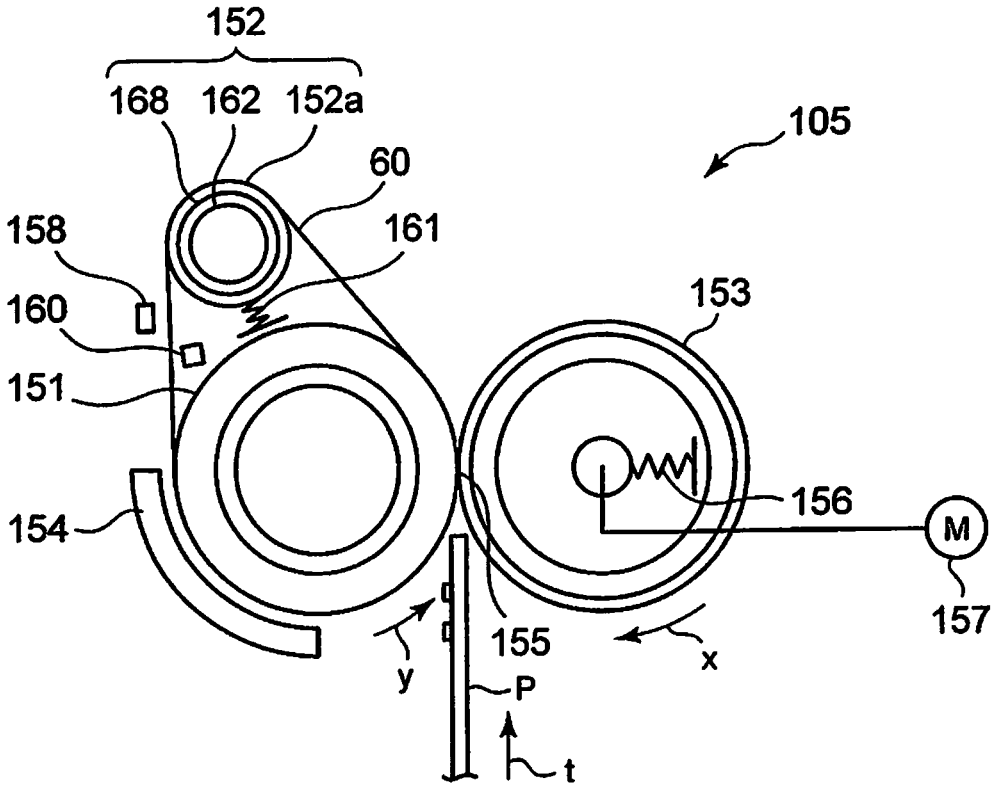
FIG. 22 is a schematic configuration diagram of a fuser viewed from a side in a fifth embodiment.

As shown in FIG. 22, a fuser 105 includes the fixing belt 60, a fixing roller 151 and a satellite roller 152 as a temperature adjusting roller. The fixing roller 151 and the satellite roller 152 support the fixing belt 60. The fuser 105 includes a press roller 153 as an opposed section, and an IH coil 154 as an induction-current generating section. The fuser 105 includes a thermistor 158 that detects the temperature of the fixing belt 60 and a thermostat 160 that detects abnormal heat generation of the fuser 105 and cuts off power supply to the IH coil 154. The satellite roller 152 applies tension to the fixing belt 60 using a spring 161. The press roller 153 is brought into pressurized contact with the fixing roller 151 by a roller pressurizing section 156 and forms a nip 155 between the press roller 153 and the fixing belt 60.

The motor 157 rotates the press roller 153 in an arrow "x" direction. The fixing belt 60 rotates in an arrow "y" direction following the press roller 153.

Figure 23:
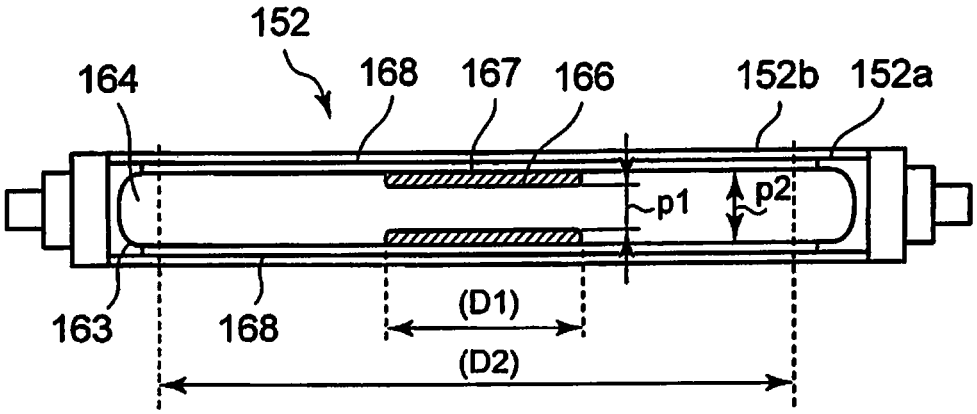
FIG. 23 is a schematic explanatory diagram of a satellite roller incorporating a heat pipe in the fifth embodiment.

The satellite roller 152 equalizes the temperature in the longitudinal direction of the fixing belt 60. As shown in FIG. 23, the satellite roller 152 incorporates a heat pipe 162 in a roller pipe 152*a* made of, for example, iron having high thermal conductivity. The roller pipe 152*a* may be formed of stainless steel, an aluminum material, or the like. The roller pipe 152*a* includes a surface protection layer 152*b* on the surface.

The heat pipe 162 is formed by sealing a solvent 164 in a pipe 163 formed of a material having high thermal conductivity such as copper or aluminum. The heat pipe 162 has length (L) extending over the entire heating area of the fixing belt 60. The heat pipe 162 has a narrowed shape in an area corresponding to the paper passing area. The diameter (p1) of the pipe 163 in a center area (D1) in the longitudinal direction where the heat pipe 162 is narrowed is smaller than the diameter (p2) of a side area (D2). The heat pipe 162 includes a heat capacity retaining member 167 of an aluminum material in a stepped portion 166 of the center area (D1) formed by narrowing the heat pipe 162. The length of the center area (D1) is equivalent to, for example, the paper passing area of the small-size sheet P. The heat capacity retaining member 167 only has to be a member having a heat capacity such as copper or iron.

The roller pipe 152*a*, the heat pipe 162, and the heat capacity retaining member 167 of the satellite roller 152 are, for example, metal-joined. The heat pipe 162 including the heat capacity retaining member 167 is fit in the roller pipe 152*a*. The heat pipe 162, the heat capacity retaining member 167, and the roller pipe 152*a* are heated at high temperature and metal-joined by shrink fitting. The heat capacity of the center area (D1) including the heat capacity retaining member 167 of the satellite roller 152 is large compared with the heat capacity of the side area (D2).

During formation of the satellite roller 152, if the roller pipe 152*a* and the heat pipe 162 are metal-joined using a solder 168 as a joining material, compared with metal-joining without the intervention of the solder 168, the joining between the roller pipe 152*a* and the heat pipe 162 stabilizes and the satellite roller 152 obtains stable heat conduction performance. For example, the solder 168 containing a silver filler is applied to the heat pipe 162 and the heat capacity retaining member 167 in advance. While the heat pipe 162 and the heat capacity retaining member 167 are fit in the roller pipe 152*a* and the heat pipe 162, the heat capacity retaining member 167, and the roller pipe 152*a* are heated at high temperature and shrink-fit, the solder 168 changes to a liquid state and fills a gap between the roller pipe 152*a* and the heat pipe 162.

If the solder 168 is too thick, the solder 168 becomes thermal resistance against heat conduction between the roller pipe 152*a* and the heat pipe 162. The solder 168 is set to thickness that does not hinder efficiency of heat conduction between the roller pipe 152*a* and the heat pipe 162. The silver filler contained in the solder 168 improves the heat conduction efficiency between the roller pipe 152*a* and the heat pipe 162. A high-heat conductive filler replacing the silver filler may be contained in the solder 168.

The solder 168 may be applied to only an area of the satellite roller 152 where high heat conduction performance is necessary. For example, the solder 168 may be applied to only an area corresponding to the paper passing area where a temperature drop is large during continuous paper feeding of the small-size sheet P. Alternatively, the solder 168 may be applied to only an area corresponding to the non-paper passing area where a temperature rise is large during continuous paper feeding of the small-size sheet P. The high-heat conductive filler may be contained in the solder 168 only in an area of the satellite roller 152 where high heat conduction performance is necessary.

In the satellite roller 152, in order to improve heat conduction efficiency with the fixing belt 60, the high-heat conductive filler may be contained in the surface protection layer 152*b* on the surface of the roller pipe 152*a*. The high-heat conductive filler may be contained only in an area of the surface protection layer 152*b* where high heat conduction performance is necessary, for example, an area corresponding to the paper passing area where a temperature drop is large during continuous paper feeding of the small-size sheet P or an area corresponding to the non-paper passing area where a temperature rise is large during continuous paper feeding of the small-size sheet P.

While the power supply for the MFP 1 is off, the press roller 61 separates from the fixing belt 60. If the power supply for the MFP 1 is turned on or the MFP 1 is reset from the sleep mode, the fuser 105 starts warming-up. The CPU 100 turns on the roller pressurizing section 156, brings the press roller 61 into contact with the fixing belt 60, and forms the nip 155. The CPU 100 turns on the motor 157 and the IH coil 154, rotates the press roller 61 and the fixing belt 60, and causes the fixing belt 60 to generate heat.

If the warming-up is completed and the fuser 105 reaches the ready temperature, the CPU 100 controls the IH coil 154 to be turned on and off according to a detection result of the thermistor 158 to keep the fixing belt 60 at the ready temperature. At a point when the warming-up is completed, the satellite roller 152 uniformly keeps the ready temperature in the longitudinal direction.

When the MFP 1 starts print, the fuser 105 controls the fixing belt 60 to fixing temperature, holds the sheet P having toner images with the nip 155, conveys the sheet P in the arrow "t" direction, and heats and pressurizes the sheet P to fix the toner images on the sheet P. The heat of the fixing belt 60 is deprived by the sheet P and the temperature in the paper passing area in the longitudinal direction of the fixing belt 60 drops. If the fixing belt 60 after the fixing reaches the satellite roller 152, the satellite roller 152 conducts heat to the temperature drop area of the fixing belt 60. Alternatively, the fixing belt 60 conducts heat from the temperature rise area to the satellite roller 152. The temperature of the fixing belt 60 is equalized while the fixing belt 60 is in contact with the satellite roller 152.

If the fixing belt 60 after the fixing reaches the satellite roller 152, a heat quantity is deprived by the fixing belt 60 in the center area (D1) of the satellite roller 152 opposed to the paper passing area. If the temperature of the center area (D1) of the satellite roller 152 drops because of the heat conduction to the fixing belt 60, the heat pipe 162 transports the heat of the side area (D2) of the satellite roller 152 to the center area (D1) and suppresses the temperature of the paper passing area of the satellite roller 152 from dropping. The heat pipe 162 equalizes the temperature of the satellite roller 152.

The satellite roller 152 prevents the print mode from being kept waiting because of temperature insufficiency of the fixing belt 60 by the heat conduction to the fixing belt 60.

When the sheet P has a small size, if the fixing operation is continued, a heat quantity is continuously transferred to the fixing belt 60 in the center area (D1) of the satellite roller 152 corresponding to the paper passing area. The heat transfer from the fixing belt 60 is continuously received in the side area (D2) of the satellite roller 152 corresponding to the non-paper passing area of the fixing belt 60. The center area (D1) of the satellite roller 152 includes the heat capacity retaining member 167 and has a large heat capacity. Since the heat capacity is large, the satellite roller 152 continuously transfers a sufficient heat quantity to the fixing belt 60. The temperature of the fixing belt 60 is equalized while the fixing belt 60 is in contact with the satellite roller 152.

If the satellite roller 152 continuously receives the heat quantity from the non-paper passing area of the fixing belt 60, the heat pipe 162 transports the heat of the side area (D2) where the temperature rises to the center area (D1) where the temperature drops. The heat capacity retaining member 167 in the center area (D1) accumulates the heat quantity transported from the non-paper passing area.

While the fixing operation is continuously performed, the satellite roller 152 prevents the print mode from being kept waiting because of temperature insufficiency in the paper passing area of the fixing belt 60 or overheat in the non-paper passing area.

Concerning a temperature distribution in the longitudinal direction of the fixing belt 60 of the fuser 105 in the case of the continuous fixing operation for the small-size sheet P, if five hundred A4-R sheets of the JIS standard are continuously subjected to fixing, a temperature distribution of the fixing belt 60 immediately after passing the nip 155 is substantially uniform in the entire area in the longitudinal direction. On the other hand, in a fuser of a comparative example in which a satellite roller including a heat pipe of a straight pipe not narrowed in the center is used, the temperature of the non-paper passing area rises and the print mode is kept waiting because of overheat. In the fuser of the comparative example, even when one small-size sheet P is subjected to fixing, a temperature rise occurs in the non-paper passing area.

If the print ends, the CPU 100 keeps the fixing belt 60 at the ready temperature. Further, if the MFP 1 changes to the sleep mode or the power supply is turned off, the CPU 100 separates the press roller 61 from the fixing belt 60 using the roller pressurizing section 156, turns off the IH coil 154 and the motor 157, and stops the MFP 1.

For example, if the fixing belt 60 abnormally generates heat during driving of the fuser 105, the thermostat 160 acts and cuts off power supply to the IH coil 154.

According to the fifth embodiment, the satellite roller 152 includes, in the roller pipe 152*a*, the heat pipe 162 narrowed in the center area (D1) and including the heat capacity retaining member 167 in the stepped portion 166. During fixing, the fuser 105 conducts heat from the center area (D1) of the satellite roller 152 to the fixing belt 60 and prevents the print mode from being kept waiting because of temperature insufficiency in the paper passing area. Alternatively, the fuser 105 conducts heat from the fixing belt 60 to the side area (D2) of the satellite roller 152 and prevents the print mode from being kept waiting because of overheat in the non-paper passing area. If the small-size sheet P is continuously subjected to fixing, the fuser 105 can conduct sufficient heat to the fixing belt 60 using the heat capacity retaining member 167 of the heat pipe 162 and prevents the print mode from being kept waiting because of temperature insufficiency in the paper passing area.

According to the fifth embodiment, the roller pipe 152*a* and the heat pipe 162 are metal-joined by the solder 168 to fill the gap between the roller pipe 152*a* and the heat pipe 162. Therefore, the satellite roller 152 obtains stable heat conduction performance. The high-heat conductive filler is contained in the joined section of the roller pipe 152*a* and the heat pipe 162 to improve the heat conduction efficiency between the roller pipe 152*a* and the heat pipe 162. According to the fifth embodiment, the high-heat conductive filler is contained in the surface protection layer 152*b* of the roller pipe 152*a* to improve the heat conduction efficiency between the fixing belt 60 and the satellite roller 152.

The heat pipe 162 in the fifth embodiment is not always fit in the roller pipe 152*a*. The heat pipe 162 may be used as, for example, the heat pipe of the heat equalizing layer 82 in the first embodiment. If the small-size sheet is continuously subjected to fixing by the fuser 32 according to the first embodiment, a heat quantity is sufficiently conducted from the area of the heat pipe 162 where a heat capacity is large to the paper passing area of the fixing belt 60 via the heat equalizing layer 82 to prevent the print mode from being kept waiting because of temperature insufficiency in the paper passing area.

According to at least one of the embodiments, the temperature of the fixing belt is prevented from dropping because of the heat capacity of the auxiliary heat generating section during the start of warming-up to reduce a warming-up time. Heat is conducted from the auxiliary heat generating section to the fixing belt during fixing to prevent the print mode from being kept waiting because of temperature insufficiency in the paper passing area. Alternatively, heat is conducted from the fixing belt to the auxiliary heat generating section to prevent the print mode from being kept waiting because of overheat in the non-paper passing area. The area including the heat capacity retaining member and having a large heat capacity is provided in the heat pipe to conduct a sufficient heat quantity to the temperature drop area of the fixing belt. A heat quantity conducted from the temperature rise area of the fixing belt is accumulated in the heat capacity retaining member and effectively used.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A fuser comprising:

a fixing belt including a conductive layer;

an induction-current generating section configured to induction-heat the conductive layer;

an opposed section to form a nip in cooperation with the fixing belt;

an auxiliary heat generating section including a heat equalizing layer incorporating a heat pipe and a magnetic auxiliary heat generating layer, the auxiliary heat generating section being configured to be induction-heated by the induction-current generating section; and a moving section configured to move the auxiliary heat generating section with respect to the fixing belt.

2. The fuser of claim 1, wherein the moving section is configured to move the auxiliary heat generating section in a direction toward an inner circumference of the fixing belt and a direction away from the inner circumference of the fixing belt.

3. The fuser of claim 2, wherein the moving section is configured to move the auxiliary heat generating section toward the inner circumference of the fixing belt in association with movement of the opposed section in a direction for forming the nip and move the auxiliary heat generating section in the direction away from the inner circumference of the fixing belt in association with movement of the opposed section in a direction away from the fixing belt.

4. The fuser of claim 2, wherein the moving section is configured to move the auxiliary heat generating section independently from movement of the opposed section.

5. The fuser of claim 1, further comprising a nip forming member to pressurize the fixing belt against the opposed section.

6. The fuser of claim 1, wherein the heat equalizing layer is formed of a magnetic material.

7. The fuser of claim 1, wherein the auxiliary heat generating layer is a plating layer formed on a surface of the heat equalizing layer opposed to the fixing belt.

8. The fuser of claim 1, wherein the auxiliary heat generating section further includes a safety device, and the heat pipe is disposed so as to not overlap with the safety device.

9. The fuser of claim 1, wherein the heat pipe includes an area having a heat capacity that is different from the other areas in a longitudinal direction.

10. The fuser of claim 1, wherein the heat pipe includes an area having an outer diameter that is different from the other areas in a longitudinal direction.

11. An image forming apparatus comprising:

an image forming section configured to form an image on a recording medium;

a fixing belt including a conductive layer and configured to contact with the recording medium;

an induction-current generating section configured to induction-heat the conductive layer;

an opposed section to form a nip in cooperation with the fixing belt;

an auxiliary heat generating section including a heat equalizing layer incorporating a heat pipe and a magnetic auxiliary heat generating layer, the auxiliary heat generating section being configured to be induction-heated by the induction-current generating section; and a moving section configured to move the auxiliary heat generating section with respect to the fixing belt.

12. The apparatus of claim 11, wherein the moving section is configured to move the auxiliary heat generating section in a direction toward an inner circumference of the fixing belt and a direction away from the inner circumference of the fixing belt.

13. The apparatus of claim 11, further comprising a nip forming member to pressurize the fixing belt against the opposed section.

* * * * *